US008071018B2

(12) United States Patent
Kariya et al.

(10) Patent No.: US 8,071,018 B2
(45) Date of Patent: Dec. 6, 2011

(54) HIGH CARBON HOT-ROLLED STEEL SHEET

(75) Inventors: Nobusuke Kariya, Kanagawa (JP); Norio Kanamoto, Chiba (JP); Hidekazu Ookubo, Chiba (JP); Yoshiharu Kusumoto, Chiba (JP); Takeshi Fujita, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 12/803,232

(22) Filed: Jun. 22, 2010

(65) Prior Publication Data

US 2010/0266441 A1 Oct. 21, 2010

Related U.S. Application Data

(62) Division of application No. 11/922,250, filed as application No. PCT/JP2006/312670 on Jun. 19, 2006, now abandoned.

(30) Foreign Application Priority Data

Jun. 29, 2005 (JP) ..... 2005-189578

(51) Int. Cl.
*C22C 38/02* (2006.01)
*C22C 38/04* (2006.01)

(52) U.S. Cl. ..... 420/117; 420/89; 420/120; 420/126; 420/121; 420/104; 420/119; 420/128; 148/602; 148/337; 148/330; 148/333; 148/336

(58) Field of Classification Search ..... 148/602, 148/337, 330, 333, 336; 420/89, 120, 117, 420/126, 121, 104, 119, 128
See application file for complete search history.

(56) References Cited

U.S. PATENT DOCUMENTS

2005/0199322 A1 9/2005 Nakamura et al.
2009/0095382 A1 4/2009 Kariya et al.

FOREIGN PATENT DOCUMENTS

JP 03-174909 A 7/1991

(Continued)

OTHER PUBLICATIONS machine translation of JP 2003013145.*
International Search Report (in English) dated Sep. 19, 2006 for PCT/JP2006/312670.
Supplementary European Search Report dated Jul. 17, 2008 for EP 06 76 7287.
P. Spiekermann, "Legierungen—Ein Besonders Patentrecht Liches Problem . . . ", *Mitteilungen Der Deutschen Patentawaelte*, pp. 178-190 (1993) together with S. Spiekermann, "Alloys—a special problem of patent law" *Non Published English Translation of Document*, pp. 1-20.

*Primary Examiner* — Emily Le
*Assistant Examiner* — Rebecca Lee
(74) *Attorney, Agent, or Firm* — RatnerPrestia

(57) ABSTRACT

A high carbon hot-rolled steel sheet which is a hot-rolled spheroidizing annealed material, including 0.2 to 0.7% C, 2% or less Si, 2% or less Mn, 0.03% or less P, 0.03% or less S, 0.08% or less Sol.Al., and 0.01% or less N, by mass, which contains carbide having a particle size of smaller than 0.5 μm in a content of 15% or less by volume to the total amount of carbide, and the difference between the maximum hardness $H_{v\ max}$ and the minimum hardness $H_{v\ min}$, $\Delta H_v$ ($=H_{v\ max}-H_{v\ min}$), in the sheet thickness direction being 10 or smaller.

5 Claims, 1 Drawing Sheet

FOREIGN PATENT DOCUMENTS

| | | | |
|---|---|---|---|
| JP | 05-009588 | A | 1/1993 |
| JP | 05-195056 | A | 8/1993 |
| JP | 05-255799 | A | 10/1993 |
| JP | 06-271935 | A | 9/1994 |
| JP | 09-157758 | A | 6/1997 |
| JP | 11279637 | | 10/1999 |
| JP | 2003-013144 | A | 1/2003 |
| JP | 2003-013145 | | 1/2003 |
| JP | 2003-013145 | A | 1/2003 |
| JP | 2003-073740 | A | 3/2003 |
| JP | 2003-073742 | A | 3/2003 |
| JP | 2003-089846 | A | 3/2003 |
| JP | 2004-137554 | A | 5/2004 |
| JP | 2005-097740 | A | 4/2005 |
| JP | 2006-063394 | A | 3/2006 |
| JP | 2006-097109 | A | 4/2006 |

* cited by examiner

HIGH CARBON HOT-ROLLED STEEL SHEET

CROSS-REFERENCE TO RELATED APPLICATIONS

This application is a Divisional application of application Ser. No. 11/922,250, filed Oct. 29, 2008 now abandoned, which is the United States national phase application of International application PCT/JP2006/312670, filed Jun. 19, 2006. The entire contents of each of application Ser. No. 11/922,250 and International application PCT/JP2006/312670 are hereby incorporated by reference herein.

TECHNICAL FIELD

The present invention relates to a high carbon hot-rolled steel sheet having excellent workability and a method for manufacturing thereof.

BACKGROUND ART

Users of high carbon steel sheets as tools, automotive parts (gear and transmission), and the like request excellent workability because these steel sheets are formed in various complex shapes. In recent years, on the other hand, requirement of reduction in the cost for manufacturing parts increases. Responding to the requirement, some working processes are eliminated and working methods are changed. For example, as the forming technology of automobile driving system parts using high carbon steel sheets, there was developed a double-acting forming technique which allows applying thickness-additive forming process and realizes significant shortening of manufacturing process, and the technique has been brought into practical applications in a part of industries, (for example, refer to Journal of the JSTP, 44, pp. 409-413, (2003)).

Along with that movement, the high carbon steel sheets face ever-increasing request of workability to attain higher ductility than ever. Since some of the parts are often subjected to hole-expansion (burring) treatment after punching, they are wanted to have excellent stretch-flange formability.

Furthermore, from the viewpoint of cost reduction accompanied with increase in the product yield, these steel sheets are strongly requested to have homogeneous mechanical properties. In particular, the homogeneity of hardness in the sheet thickness direction is keenly desired because large differences of hardness in the steel sheet thickness direction between the surface portion and the central portion significantly deteriorate the punching tool during punching.

To answer these requests, several technologies were studied to improve the workability and homogeneous mechanical properties of high carbon steel sheets.

For example, JP-A-3-174909, (the term "JP-A" referred to herein signifies the "Unexamined Japanese Patent Publication"), proposed a method for manufacturing stably a high carbon hot-rolled steel strip having excellent homogeneous mechanical properties in the longitudinal direction of coil by the steps of:

- dividing a hot-run table (or run-out table) into an accelerated cooling zone and an air-cooling zone;
- applying accelerated cooling to a finish-rolled steel strip to a specific temperature or below determined by the length of cooling zone, the transfer speed of steel sheet, the chemical composition of the steel, and the like; and then
- applying air-cooling to the steel strip. The cooling rate in the accelerated cooling zone according to JP-A-3-174909 is about 20 to about 30° C./s suggested by FIG. 3 in the disclosure.

As another example, JP-A-9-157758 proposed a method for manufacturing high carbon workable steel strip having excellent structural homogeneity and workability (ductility) by the steps of:

- hot-rolling a high carbon steel having a specified chemical composition, followed by descaling therefrom;
- annealing the steel in a hydrogen atmosphere (95% or more of hydrogen by volume) while specifying heating rate, soaking temperature ($A_{c1}$ transformation point or above), and soaking time depending on the chemical composition; and
- cooling the annealed steel at cooling rates of 100° C./hr or smaller.

As further example, JP-A-5-9588 proposed a method for manufacturing high carbon steel thin sheet having good workability by the steps of:

- rolling a steel at finishing temperatures of ($A_{c1}$ transformation point+30° C.) or above to prepare a steel sheet;
- cooling the steel sheet to temperatures from 20 ° C. to 500° C. at cooling rates from 10 to 100° C./s;
- holding the steel sheet for 1 to 10 seconds;
- reheating the steel sheet to temperatures from 500° C. to ($A_{c1}$ transformation point+30° C.), followed by coiling the steel sheet; and
- soaking the steel sheet, at need, at temperatures from 650° C. to ($A_{c1}$ transformation point+30° C.) for 1 hour or more.

As still another example, JP-A-2003-13145 proposed a method for manufacturing high carbon steel sheet having excellent stretch-flanging formability by the steps of:

- using a steel containing 0.2 to 0.7% C by mass;
- hot-rolling the steel at finishing temperatures of ($A_{r3}$ transformation point−20° C.) or above;
- cooling the steel sheet at cooling rates of higher than 120° C. is and at cooling-stop temperatures of not higher than 650° C.;
- coiling the steel sheet at temperatures of 600° C. or below; and then
- annealing the steel sheet at temperatures from 640° C. or larger to $A_{c1}$ transformation point or lower.

Although the object does not agree with that of above examples, JP-A-2003-73742 disclosed a technology for manufacturing high carbon hot-rolled steel sheet which satisfies the above requirements except for selecting the cooling-stop temperature of 620° C. or below.

DISCLOSURE OF THE INVENTION

Problems to be Solved by the Invention

The related art, however, cannot assure the homogeneous mechanical properties including that homogeneity in the sheet thickness direction, and fails to assure that homogeneity and the stretch-flange formability.

The above related art also has the problems described below.

For the method disclosed in JP-A-3-174909, the obtained steel sheet is what is called the "as hot-rolled" steel sheet without subjected to heat treatment after hot-rolling. Accordingly, the manufactured steel sheet not necessarily attains excellent elongation and stretch-flange formability.

Regarding the method disclosed in JP-A-9-157758, a microstructure composed of pro-eutectoid ferrite and pearlite containing lamellar carbide is formed depending on the hot-rolling condition, and the succeeding annealing converts the lamellar carbide into fine spheroidal cementite. Thus formed fine spheroidal cementite becomes the origin of voids during hole-expansion step, and the generated voids connect with each other to induce fracture of the steel. As a result, no excellent stretch-flange formability is attained.

According to the method disclosed in JP-A-5-9588, the steel sheet after hot-rolling is cooled under a specified condition, followed by reheating thereof by direct electric heating process and the like. As a result, a special apparatus is required and a vast amount of electric energy is consumed. In addition, since the steel sheet coiled after reheating likely forms fine spheroidal cementite, there are often failed to obtain excellent stretch-flange formability owing to the same reason to that given above.

An object of the present invention is to provide a high carbon hot-rolled steel sheet having excellent stretch-flange formability and excellent homogeneity of hardness in the sheet thickness direction, and a method for manufacturing thereof.

Means to Solve the Problems

The inventors of the present invention conducted detail study of the effect of microstructure on the stretch-flange formability and the hardness of high carbon hot-rolled steel sheet, and found that it is extremely important to adequately control the manufacturing conditions, specifically the cooling condition after hot-rolling, the coiling temperature, and the annealing temperature, thus found that the stretch-flange formability is improved and the hardness in the sheet thickness direction becomes homogeneous by controlling the volume percentage of carbide having smaller than 0.5 μm of particle size to the total carbide in the steel sheet, determined by the method described later, to 15% or less.

Furthermore, the inventors of the present invention found that further excellent stretch-flange formability and homogeneous distribution of hardness are attained by controlling more strictly the cooling condition after hot-rolling and the coiling temperature, thereby controlling the volume percentage of the carbide to 10% or less.

The present invention has been perfected on the basis of above findings, and the present invention provides a method for manufacturing high carbon hot-rolled steel sheet having excellent workability, by the steps of: hot-rolling a steel containing 0.2 to 0.7% C by mass at finishing temperatures of ($A_{r3}$ transformation point−20° C.) or above to prepare a hot-rolled sheet; cooling thus hot-rolled sheet to temperatures of 650° C. or below, (called the "cooling-stop temperature"), at cooling rates from 60° C./s or larger to smaller than 120° C./s; coiling the hot-rolled sheet after cooling at coiling temperatures of 600° C. or below; and annealing the coiled hot-rolled sheet at annealing temperatures from 640° C. or larger to $A_{c1}$ transformation point or lower, (called the "annealing of hot-rolled sheet).

According to the method of the present invention, it is more preferable that, for the above manufacturing method, the cooling step and the coiling step are conducted by cooling the hot-rolled sheet to temperatures of 600° C. or below at cooling rates from 80° C./s or larger to smaller than 120° C./s, and then coiling the sheet at temperatures of 550° C. or below.

Generally the coiled hot-rolled sheet is subjected to descaling such as pickling before applying annealing of hot-rolled sheet.

The present invention provides a high carbon hot-rolled steel sheet which is a hot-rolled spheroidizing annealed material, which steel sheet contains 0.2 to 0.7% C, 2% or less Si, 2% or less Mn, 0.03% or less P, 0.03% or less S, 0.08% or less Sol.Al, and 0.01% or less N, by mass, in which the quantity of carbide having smaller than 0.5 μm of particle size is 15% or smaller by volume to the total amount of carbide, further the difference between the maximum hardness $H_{V\ max}$ and the minimum hardness $H_{V\ min}$, ΔHv (=$H_{V\ max}$−$H_{V\ min}$), in the sheet thickness direction is 10 or less.

It is more preferable that the above volume percentage of carbide having smaller than 0.5 μm in particle size is 10% or less, and that above ΔHv is 8 or smaller.

BEST MODE FOR CARRYING OUT THE INVENTION

Figure 1:
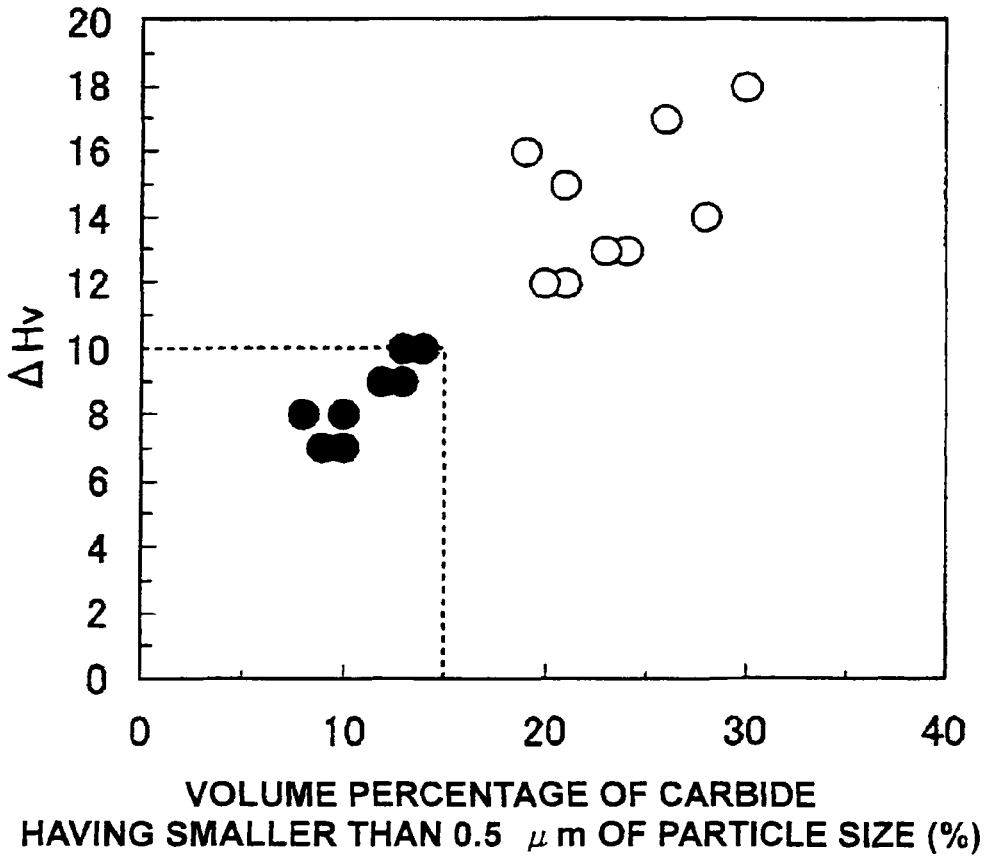
FIG. 1 shows the relation between ΔHv (vertical axis) and volume percentage (horizontal axis) of carbide having smaller than 0.5 μm of particle size.

The high carbon hot-rolled steel sheet and the method for manufacturing thereof according to the present invention are described below in detail.

<Steel Composition>

(1) C Content

Carbon is an important element of forming carbide and providing hardness after quenching. If the C content is less than 0.2% by mass, formation of pre-eutectoid ferrite after hot-rolling becomes significant, and the volume percentage of carbide having smaller than 0.5 μm of particle size after annealing of hot-rolled sheet, (the volume percentage to the total carbide in the steel sheet), increases, thereby deteriorating the stretch-flange formability and the homogeneity of hardness in the sheet thickness direction. In addition, even after quenching, satisfactory strength as the machine structural parts cannot be attained. On the other hand, if the C content exceeds 0.7% by mass, sufficient stretch-flange formability cannot be attained even if the volume percentage of carbide having smaller than 0.5 μm of particle size is 15% or less. In addition, the hardness after hot-rolling significantly increases to result in inconvenience in handling owing to the brittleness of the steel sheet, and also the strength as the machine structural parts after quenching saturates. Therefore, the C content is specified to a range from 0.2 to 0.7% by mass.

For the case that the hardness after quenching is emphasized, it is preferable to specify the C content to above 0.5% by mass. For the case that the workability is emphasized, it is preferable to specify the C content to 0.5% or less by mass.

(2) Other Steel Compositions

Although there is no specific limitation on the elements other than C, elements such as Mn, Si, P, S, Sol.Al, and N can be added within ordinary respective ranges. Since, however, Si likely converts carbide into graphite, thus interfering the hardenability by quenching, the Si content is preferably specified to 2% or less by mass. Since excess amount of Mn likely induces the decrease in ductility, the Mn content is preferably specified to 2% or less by mass. Since excess amount of P and S decreases ductility and likely induces cracks, the content of P and S is preferably specified to 0.03% or less by mass, respectively. Since excess amount of Sol.Al deteriorates the hardenability by quenching owing to the precipitation of AlN in a large amount, the Sol.Al content is preferably specified to 0.08% or less by mass. Since excess amount of N deteriorates ductility, the N content is preferably specified to 0.01% or less by mass. Preferable respective contents of these elements are: 0.5% or less Si, 1% or less Mn, 0.02% or less P, 0.05% or less Sol.Al, and 0.005% or less N, by mass. For improving the stretch-flange formability, the S content is preferably reduced. For example, the stretch-flange formability is further significantly improved by specifying the S content to 0.007% or less by mass. When each of these elements is decreased to less than 0.0001% by mass, the cost increases so that the content thereof is preferably accepted by amounts of 0.0001% by mass or more.

Depending on the objectives of improvement in hardenability by quenching and/or improvement in resistance to temper softening, the effect of the present invention is not affected by the addition of at least one of the elements such as B, Cr, Cu, Ni, Mo, Ti, Nb, W, V, and Zr within ordinarily adding ranges to the high carbon hot-rolled steel sheet. Specifically for these elements, there can be added: B in amounts of about 0.005% or less by mass, Cr about 3.5% or less by mass, Ni about 3.5% or less by mass, Mo about 0.7% or less by mass, Cu about 0.1% or less by mass, Ti about 0.1% or less by mass, Nb about 0.1% or less by mass, and W, V, and Zr, as the total, about 0.1% or less by mass. On adding Cr and/or Mo, it is preferable to add Cr in amounts of about 0.05% or more by mass and Mo about 0.05% or more by mass.

Balance of above composition is preferably iron and inevitable impurities. For example, even if elements such as Sn and Pb entered the steel composition as impurities during the manufacturing process, they do not affect the effect of the present invention.

<Hot-rolling Conditions>

(3) Finishing Temperature of Hot-Rolling

If the finishing temperature is below ($A_{r3}$ transformation point−20° C.), the ferrite transformation proceeds in a part, which increases the volume percentage of carbide having smaller than 0.5 μm of particle size, thereby deteriorating both the stretch-flange formability and the homogeneity of hardness in the sheet thickness direction. Accordingly, the finishing temperature of hot-rolling is specified to ($A_{r3}$ transformation point−20° C.) or above. The $A_{r3}$ transformation point may be the actually determined value, and may be the calculated value of the following formula (1).

$$A_{r3}\text{ transformation point}=910-203[C]^{1/2}+44.7[Si]-30[Mn] \quad (1)$$

where, [M] designates the content (% by mass) of the element M.

Responding to the additional elements, correction terms such as (−11[Cr]), (+31.5[Mo]), and (−15.2[Ni]) may be added to the right-hand member of the formula (1).

(4) Condition of Cooling after Hot-Rolling

If the cooling rate after hot-rolling is smaller than 60° C./s, the supercooling of austenite becomes small, and the formation of pre-eutectoid ferrite after hot-rolling becomes significant. As a result, the volume percentage of carbide having smaller than 0.5 μm of particle size exceeds 15% after annealing of hot-rolled sheet, thereby deteriorating both the stretch-flange formability and the homogeneity of hardness in the sheet thickness direction.

If the cooling rate exceeds 120° C./s, the temperature difference in the sheet thickness direction, between the surface portion and the central portion, increases, and the formation of pre-eutectoid ferrite becomes significant at the central portion. As a result, both the stretch-flange formability and the homogeneity of hardness in the sheet thickness direction deteriorate, similar to above. The tendency becomes specifically large when the sheet thickness of hot-rolled steel sheets becomes 4.0 mm or larger.

That is, to specifically homogenize the hardness in the sheet thickness direction, there exists an adequate cooling rate, and excessively large or excessively small cooling rates cannot attain the desired homogeneity of hardness. In related art, particularly the optimization of cooling rate is not attained so that the homogeneity of hardness cannot be assured.

Consequently, the cooling rate after hot-rolling is specified to a range from 60° C./s or larger to smaller than 120° C./s. Furthermore, if the volume percentage of carbide having smaller than 0.5 μm of particle size is to be brought to 10% or less, the cooling rate is specified to a range from 80° C./s or larger to smaller than 120° C./s. It is more preferable to specify the upper limit of the cooling rate to 115° C./s or smaller.

If the end point of the cooling of hot-rolled steel sheet with that cooling rates, or the cooling-stop temperature, is higher than 650° C., the pre-eutectoid ferrite is formed, and the pearlite containing lamella carbide is formed during the cooling step before coiling the hot-rolled steel sheet. As a result, the volume percentage of carbide having smaller than 0.5 μm of particle size exceeds 15% after annealing of hot-rolled sheet, thereby deteriorating the stretch-flange formability and the homogeneity of hardness in the sheet thickness direction. Therefore, the cooling-stop temperature is specified to 650° C. or below, and more preferably to 600° C. or below.

To bring the volume percentage of the carbide having smaller than 0.5 μm of particle size to 10% or less, there are specified, as described above, the cooling rate in a range from 80° C./s or larger to 120° C./s or smaller, (preferably 115° C./s or smaller), and the cooling-stop temperature of 600° C. or below.

Since there is a problem of accuracy of temperature measurement, the cooling-stop temperature is preferably specified to 500° C. or above.

After reaching the cooling-stop temperature, natural cooling may be applied, or forced cooling may be continued with a weakened cooling force. From the viewpoint of homogeneous mechanical properties of the steel sheet, however, forced cooling to a degree of suppressing the reheating is preferred.

(5) Coiling Temperature

The hot-rolled steel sheet after cooling is coiled. If the coiling temperature exceeds 600° C., pearlite containing lamella carbide is formed. As a result, the volume percentage of carbide having smaller than 0.5 μm of particle size exceeds 15% after annealing of hot-rolled sheet, thereby deteriorating the stretch-flange formability and the homogeneity of hardness in the sheet thickness direction. Therefore, the coiling temperature is specified to 600° C. or below. The coiling temperature is selected to a temperature below the above cooling-stop temperature.

From the viewpoint of the homogeneity of hardness, it is preferable that the above cooling-stop temperature is specified to 600° C. or below, and that the coiling temperature is specified to 550° C. or below.

For bringing the volume percentage of carbide having smaller than 0.5 μm of particle size to 10% or less, there are specified, as above, the cooling rate to a range from 80° C./s or larger to 120° C./s or smaller, (preferably 115° C./s or smaller), the cooling-stop temperature to 600° C. or below, and the coiling temperature to 550° C. or below.

To prevent the deterioration of shape of the hot-rolled steel sheet, the coiling temperature is preferably specified to 200° C. or above, and more preferably to 350° C. or above.

(6) Descaling (Pickling and the Like)

The hot-rolled steel sheet after coiling is generally subjected to descaling before applying annealing of hot-rolled sheet. Although there is no specific limitation on the scale-removal method, it is preferably to adopt ordinary pickling.

<Condition of Annealing of Hot-Rolled Sheet>

(7) Temperature of Annealing of Hot-Rolled Sheet

The hot-rolled sheet after pickling is subjected to annealing of hot-rolled sheet to spheroidize the carbide. If the temperature of annealing of hot-rolled sheet is below 640° C., the spheroidization of carbide becomes insufficient or the volume percentage of carbide having smaller than 0.5 μm of particle size increases, which deteriorates the stretch-flange formability and the homogeneity of hardness in the sheet thickness direction. On the other hand, if the annealing temperature exceeds the $A_{c1}$ transformation point, the austenite formation proceeds in a part, and the pearlite again forms during cooling, which deteriorates the stretch-flange formability and the homogeneity of hardness in the sheet thickness direction. Accordingly, the temperature of annealing of hot-rolled sheet is specified to a range from 640° C. to ($A_{c1}$ transformation point). To attain further excellent stretch-flange formability, the temperature of annealing of hot-rolled sheet is preferably specified to 680° C. or above.

The $A_{c1}$ transformation point may be the actually determined value, and may be the calculated value of the following formula (2).

$$A_{c1}\text{ transformation point}=754.83-32.25\,[C]+23.32\,[Si]-17.76\,[Mn] \quad (2)$$

where, [M] designates the content (% by mass) of the element M.

Responding to the additional elements, correction terms such as (+17.13 [Cr]), (+4.51 [Mo]), and (+15.62 [V]) may be added to the right-hand member of the formula (2).

The annealing time is preferably between about 8 hours and about 80 hours. By applying the annealing for spheroidization, the obtained hot-rolled steel sheet becomes a hot-rolled spheroidizing annealed material. The carbide treated by spheroidizing annealing gives about 5.0 or smaller average aspect ratio, (determined at a depth of about one fourth in the sheet thickness direction).

<Other>

For steel making of the high carbon steel according to the present invention, either converter or electric furnace can be applied. Thus made high carbon steel is formed into slab by ingoting and blooming or by continuous casting.

The slab is normally heated, (reheated), and then treated by hot-rolling. For the slab manufactured by continuous casting may be treated by hot direct rolling directly from the slab or after heat-holding to prevent temperature reduction. For the case of hot-rolling the slab after reheating, the slab heating temperature is preferably specified to 1280° C. or below to avoid the deterioration of surface condition caused by scale.

The hot-rolling can be given only by finish rolling eliminating rough rolling. To assure the finishing temperature, the material being rolled may be heated during hot-rolling using a heating means such as sheet bar heater. To enhance spheroidization or to decrease hardness, the coiled sheet may be thermally insulated by a slow-cooling cover or other means.

Although the thickness of the hot-rolled sheet is not specifically limited if only the manufacturing conditions of the present invention are maintained, a particularly preferable range of the thickness thereof is from 1.0 to 10.0 mm from the point of operability.

The annealing of hot-rolled sheet can be done either by box annealing or by continuous annealing. After annealing of hot-rolled sheet, skin-pass rolling is applied, at need. Since the skin-pass rolling does not affect the hardenability by quenching, there is no specific limitation of the condition of skin-pass rolling.

Regarding the amount of carbide having 0.5 μm or coarse particle size in the steel sheet, there raises no problem if only the amount is within that corresponding to the C content according to the present invention.

EXAMPLES

Example 1

Continuously cast slabs of Steels A to E having the respective chemical compositions shown in Table 1 were heated to 1250° C. Thus heated slabs were treated by hot-rolling and annealing of hot-rolled sheet under the respective conditions given in Table 2 to form the Steel sheets Nos. 1 to 19, having a sheet thickness of 5.0 mm. The annealing of hot-rolled sheet was given in a non-nitrizing atmosphere, (Ar atmosphere).

Steel sheets Nos. 1 to 10 are Examples of the present invention, and Steel sheets Nos. 11 to 19 are Comparative Examples. The following methods were adopted to determine the particle size and volume percentage of carbide, the hardness in the sheet thickness direction, and the hole-expansion rate λ. The hole-expansion rate λ was adopted as an index to evaluate the stretch-flange formability.

(i) Determination of Particle Size and Volume Percentage of Carbide

A cross section of steel sheet parallel to the rolling direction was polished, which section was then etched at a depth of one fourth of sheet thickness using a Picral solution (picric acid+ethanol). The microstructure on the etched surface was observed by a scanning electron microscope (×3000 magnification).

The particle size and volume percentage of carbide were quantitatively determined by image analysis using the image analyzing software "Image Pro Plus ver.4.0™" manufactured by Media Cybernetics, Inc. That is, the particle size of each carbide was determined by measuring the diameter between two point on outer peripheral circle of the carbide and passing through the center of gravity of an equivalent ellipse of the carbide, (an ellipse having the same area to that of carbide and having the same first moment and second moment to those of the carbide), at intervals of 2 degrees, and then averaging thus measured diameters.

Furthermore, for all the carbides within the visual field, the area percentage of every carbide to the measuring visual field was determined, which determined value was adopted as the volume percentage of the carbide. For the carbides having smaller than 0.5 μm of particle size, the sum of volume percentages, (cumulative volume percentage), was determined, which was then divided by the cumulative volume percentage of all carbides, thus obtained the volume percentage for every visual field. The volume percentage was determined on 50 visual fields, and those determined volume percentages were averaged to obtain the volume percentage of carbide having smaller than 0.5 μm of particle size.

In the above image analysis, the average aspect ratio (number average) of carbide was also calculated, and the spheroidizing annealing was confirmed.

(ii) Hardness Determination in the Sheet Thickness Direction

The cross section of steel sheet parallel to the rolling direction was polished. The hardness was determined using a micro-Vickers hardness tester applying 4.9 N (500 gf) of load at nine positions: 0.1 mm depth from the surface of the steel sheet; depths of 1/8, 2/8, 3/8, 4/8, 5/8, 6/8, and 7/8 of the sheet thickness; and 0.1 mm depth from the rear surface thereof.

The homogeneity of hardness in the sheet thickness direction was evaluated by the difference between maximum hardness $H_{V\ max}$ and the minimum hardness $H_{V\ min}$, ΔHv ($=H_{V\,max}-H_{V\,min}$). When $\Delta Hv \leqq 10$, the homogeneity of hardness was evaluated as excellent.

(iii) Determination of Hole-Expansion Rate λ

The steel sheet was punched using a punching tool having a punch diameter of 10 mm and a die diameter of 12 mm (20% of clearance). Then, the punched hole was expanded by pressing-up a cylindrical flat bottom punch (50 mm in diameter and 8 mm in shoulder radius). The hole diameter d (mm) at the point of generating penetration crack at hole-edge was determined. Then, the hole-expansion rate λ (%) was calculated by the formula (3).

$$\lambda=100\times(d-10)/10 \quad (3)$$

Similar tests were repeated for total six times, and the average hole-expansion rate λ was determined.

Table 3 shows the result. Steel sheets Nos. 1 to 10, which are Examples of the present invention, gave 15% or smaller volume percentage of carbide having smaller than 0.5 μm of particle size, and, compared with Steel sheets Nos. 11 to 19, which are Comparative Examples with the same chemical compositions, respectively, the hole-expansion rate λ was large, and the stretch-flange formability was superior. A presumable cause of the high hole-expansion rate λ, is that, as described above, although the fine carbide having smaller than 0.5 μm of particle size acts as the origin of voids during hole-expansion step, which generated voids connect with each other to induce fracture, the quantity of that fine carbide decreases to 15% or less by volume.

FIG. 1 shows the relation between the ΔHv (vertical axis) and the volume percentage of carbide having smaller than 0.5 μm of particle size, (horizontal axis). As in the case of Steel sheets Nos. 1 to 10, which are Examples of the present invention, when the volume percentage of the carbide having smaller than 0.5 μm of particle size is brought to 15% or less, ΔHv becomes 10 or less, adding to the excellent stretch-flanging formability as described above, thereby providing excellent homogeneity of hardness in the sheet thickness direction, (black circle in FIG. 1). A presumable cause of the effect of fine carbide on the homogeneity of hardness is that the fine carbide likely segregates into a zone where pearlite existed.

Steel sheets Nos. 2, 4, 6, 8, and 10, which are Examples of the present invention, having 10% or less of volume percentage of carbide having smaller than 0.5 μm of particle size, prepared under the conditions of 600° C. or below of cooling-stop temperature and 550° C. or below of coiling temperature, provided not only more excellent stretch-flange formability but also more excellent homogeneity of hardness, of ΔHv of 8 or smaller, in sheet thickness direction.

TABLE 1

| | Composition (mass %) | | | | | | | $A_{r3}$ transformation | $A_{c1}$ transformation |
|---|---|---|---|---|---|---|---|---|---|
| Steel | C | Si | Mn | P | S | Sol. Al | N | point* (° C.) | point** (° C.) |
| A | 0.26 | 0.22 | 0.83 | 0.010 | 0.0025 | 0.037 | 0.0031 | 791 | 737 |
| B | 0.34 | 0.20 | 0.74 | 0.015 | 0.0018 | 0.026 | 0.0033 | 778 | 735 |
| C | 0.35 | 0.02 | 0.15 | 0.009 | 0.0030 | 0.034 | 0.0036 | 786 | 741 |
| D | 0.49 | 0.19 | 0.76 | 0.011 | 0.0027 | 0.036 | 0.0032 | 754 | 730 |
| E | 0.66 | 0.21 | 0.75 | 0.014 | 0.0045 | 0.027 | 0.0030 | 732 | 725 |

*Calculated by the formula (1).
**Calculated by the formula (2).

TABLE 2

| | | Hot-rolling conditions | | | | | |
|---|---|---|---|---|---|---|---|
| Steel sheet No. | Steel | Finishing temperature (° C.) | Cooling rate (° C./s) | Cooling-stop temperature (° C.) | Coiling temperature (° C.) | Annealing of hot-rolled sheet | Remark |
| 1 | A | 801 | 110 | 620 | 550 | 700° C. × 40 hr | Example |
| 2 | A | 811 | 95 | 560 | 510 | 720° C. × 40 hr | Example |
| 3 | B | 788 | 115 | 610 | 540 | 680° C. × 40 hr | Example |
| 4 | B | 808 | 85 | 570 | 520 | 710° C. × 40 hr | Example |
| 5 | C | 801 | 75 | 610 | 590 | 670° C. × 40 hr | Example |
| 6 | C | 806 | 105 | 580 | 490 | 720° C. × 40 hr | Example |
| 7 | D | 774 | 90 | 620 | 580 | 710° C. × 40 hr | Example |
| 8 | D | 784 | 100 | 550 | 500 | 720° C. × 40 hr | Example |
| 9 | E | 752 | 65 | 600 | 570 | 700° C. × 40 hr | Example |
| 10 | E | 772 | 100 | 540 | 490 | 720° C. × 40 hr | Example |
| 11 | A | 801 | 80 | 680 | 580 | 700° C. × 40 hr | Comparative example |
| 12 | A | 751 | 100 | 610 | 570 | 700° C. × 40 hr | Comparative example |
| 13 | B | 798 | 110 | 620 | 560 | 600° C. × 40 hr | Comparative example |
| 14 | B | 793 | 90 | 600 | 630 | 690° C. × 40 hr | Comparative example |
| 15 | C | 816 | 150 | 580 | 520 | 720° C. × 40 hr | Comparative example |
| 16 | C | 806 | 55 | 630 | 550 | 710° C. × 40 hr | Comparative example |
| 17 | D | 794 | 115 | 670 | 590 | 720° C. × 40 hr | Comparative example |
| 18 | D | 719 | 95 | 610 | 580 | 680° C. × 40 hr | Comparative example |
| 19 | E | 752 | 130 | 590 | 550 | 710° C. × 40 hr | Comparative example |

TABLE 3

| Steel sheet No. | Volume percentage of carbide having smaller than 0.5 μm of particle size (%) | ΔHv | λ (%) | Remark |
|---|---|---|---|---|
| 1 | 13 | 9 | 111 | Example |
| 2 | 9 | 7 | 128 | Example |
| 3 | 12 | 9 | 72 | Example |
| 4 | 8 | 8 | 83 | Example |
| 5 | 13 | 10 | 69 | Example |
| 6 | 10 | 7 | 86 | Example |
| 7 | 14 | 10 | 48 | Example |
| 8 | 9 | 7 | 56 | Example |
| 9 | 12 | 9 | 36 | Example |
| 10 | 10 | 8 | 42 | Example |
| 11 | 28 | 14 | 75 | Comparative Example |
| 12 | 21 | 15 | 69 | Comparative Example |
| 13 | 19 | 16 | 44 | Comparative Example |
| 14 | 24 | 13 | 37 | Comparative Example |
| 15 | 21 | 12 | 53 | Comparative Example |
| 16 | 30 | 18 | 39 | Comparative Example |
| 17 | 20 | 12 | 22 | Comparative Example |
| 18 | 23 | 13 | 17 | Comparative Example |
| 19 | 26 | 17 | 13 | Comparative Example |

Example 2

Continuous casting was applied to the steels given below to form the respective slabs:

Steel F (0.31% C, 0.18% Si, 0.68% Mn, 0.012% P, 0.0033% S, 0.025% Sol.Al, and 0.0040% N, bymass; 785° C. of $A_{r3}$ transformation point; and 737° C. of $A_{c1}$ transformation point);

Steel G (0.23% C, 0.18% Si, 0.76% Mn, 0.016% P, 0.0040% S, 0.025% Sol.Al, 0.0028% N, and 1.2% Cr, by mass; 785° C. of $A_{r3}$ transformation point; and 759° C. of $A_{c1}$ transformation point);

Steel H (0.32% C, 1.2% Si, 1.5% Mn, 0.025% P, 0.010% S, 0.06% Sol.Al, and 0.0070% N, by mass; 804° C. of $A_{r3}$ transformation point; and 746° C. of $A_{c1}$ transformation point);

Steel I (0.35% C, 0.20% Si, 0.68% Mn, 0.012% P, 0.0038% S, 0.032% Sol.Al, 0.0033% N, 0.98% Cr, and 0.17% Mo, by mass; 773° C. of $A_{r3}$ transformation point; and 754° C. of $A_{c1}$ transformation point) ; and Steel E given in Table 1.

These slabs were heated to 1230° C., which were then treated by hot-rolling and annealing of hot-rolled sheet under the respective conditions shown in Table 4, thus manufactured the Steel Sheets Nos. 20 to 36, having 4.5 mm in sheet thickness. The annealing of hot-rolled sheet was given in a non-nitrizing atmosphere ($H_2$ atmosphere).

To thus prepared hot-rolled steel sheets, similar method to that in Example 1 was applied to determine the particle size and volume percentage of carbide, the hardness in the sheet thickness direction, and the hole-expansion rate λ. The results are given in Table 5.

Among Steel sheets Nos. 20 to 26 in which the conditions other than the cooling rate were kept constant, Steel sheets Nos. 21 to 25 in which the cooling rate was within the range of the present invention showed significantly excellent stretch-flange formability and homogeneity of hardness in the sheet thickness direction. Steel sheets Nos. 22 to 25 showed further significant improvement in these characteristics, giving maximum values thereof at around 100° C./s (for Steel sheets Nos. 23 to 25).

As for Steel sheets Nos. 27 to 32 which were treated by a constant cooling rate, Steel sheets Nos. 29 to 32 which are within the range of the present invention in both the cooling-stop temperature and the coiling temperature gave significantly excellent values in the stretch-flange formability and the homogeneity of hardness in the sheet thickness direction. For the case of satisfying 600° C. or lower cooling-stop temperature and of 550° C. or lower coiling temperature, (Steel sheet No. 32), the volume percentage of fine carbide became 10% or less, thus further significantly excellent stretch-flange formability and homogeneity of hardness in the sheet thickness direction were attained.

Steels E to I which have the steel compositions within the range of the present invention showed excellent stretch-flange formability and excellent homogeneity of hardness in the sheet thickness direction, including the cases of adding alloying elements other than the basic components, (Steel G and Steel I). When, however, Steel F, Steel G, and Steel I gave further and significantly excellent absolute values of hole-expansion rate compared with the case of large quantity of other basic elements, (Steel H).

TABLE 4

| Steel sheet No. | Steel | Hot-rolling conditions: Finishing temperature (° C.) | Cooling rate (° C./s) | Cooling-stop temperature (° C.) | Coiling temperature (° C.) | Annealing of hot-rolled sheet |
|---|---|---|---|---|---|---|
| 20 | F | 820 | 50 | 560 | 530 | 700° C. × 30 hr |
| 21 | F | 820 | 70 | 560 | 530 | 700° C. × 30 hr |
| 22 | F | 820 | 85 | 560 | 530 | 700° C. × 30 hr |
| 23 | F | 820 | 95 | 560 | 530 | 700° C. × 30 hr |
| 24 | F | 820 | 105 | 560 | 530 | 700° C. × 30 hr |
| 25 | F | 820 | 115 | 560 | 530 | 700° C. × 30 hr |
| 26 | F | 820 | 140 | 560 | 530 | 700° C. × 30 hr |
| 27 | F | 820 | 105 | 660 | 530 | 700° C. × 30 hr |
| 28 | F | 820 | 105 | 630 | 610 | 700° C. × 30 hr |
| 29 | F | 820 | 105 | 630 | 560 | 700° C. × 30 hr |
| 30 | F | 820 | 105 | 630 | 530 | 700° C. × 30 hr |
| 31 | F | 820 | 105 | 580 | 560 | 700° C. × 30 hr |
| 32 | F | 820 | 105 | 580 | 530 | 700° C. × 30 hr |
| 33 | E | 790 | 105 | 560 | 530 | 715° C. × 60 hr |
| 34 | G | 800 | 105 | 560 | 530 | 720° C. × 50 hr |
| 35 | H | 810 | 105 | 560 | 530 | 700° C. × 30 hr |
| 36 | I | 820 | 105 | 560 | 530 | 700° C. × 30 hr |

TABLE 5

| Steel sheet No. | Volume percentage of carbide having smaller than 0.5 μm of particle size (%) | ΔHv | λ (%) |
|---|---|---|---|
| 20 | 22 | 15 | 42 |
| 21 | 13 | 10 | 70 |
| 22 | 10 | 9 | 78 |
| 23 | 8 | 9 | 84 |
| 24 | 6 | 7 | 93 |
| 25 | 7 | 8 | 88 |
| 26 | 23 | 17 | 38 |
| 27 | 26 | 16 | 45 |
| 28 | 23 | 17 | 39 |
| 29 | 11 | 9 | 70 |
| 30 | 13 | 10 | 74 |
| 31 | 12 | 10 | 75 |
| 32 | 7 | 7 | 89 |
| 33 | 9 | 7 | 50 |
| 34 | 8 | 9 | 95 |
| 35 | 9 | 7 | 67 |
| 36 | 9 | 9 | 80 |

INDUSTRIAL APPLICABILITY

The present invention has realized the manufacture of high carbon hot-rolled steel sheet which gives excellent stretch-flange formability and excellent homogeneity of hardness in the sheet thickness direction without adding special apparatus.

What is claimed is:

1. A high carbon hot-rolled steel sheet which is a hot-rolled spheroidizing annealed material, comprising 0.2 to 0.7% C, 2% or less Si, 2% or less Mn, 0.03% or less P, 0.03% or less S, 0.08% or less Sol.Al., and 0.01% or less N, by mass, which contains carbide having a particle size of smaller than 0.5 μm in a content of 15% or less by volume to the total amount of carbide, and the difference between the maximum hardness $Hv_{max}$ and the minimum hardness $Hv_{min}$, ΔHv ($=Hv_{max}-Hv_{min}$) in the sheet thickness direction being 10 or smaller.

2. The high carbon hot-rolled steel sheet according to claim 1, wherein the content of carbide having a particle size smaller than 0.5 μm is 10% or less by volume to the total amount of carbide, and the difference between the maximum hardness $Hv_{max}$ and the minimum hardness $Hv_{min}$, ΔHv ($=Hv_{max}-Hv_{min}$), in the sheet thickness direction being 8 or smaller.

3. The high carbon hot-rolled steel sheet according to claim 1, further comprising at least one element selected from the group consisting of about 0.005% or less B, about 3.5% or less Cr, about 3.5% or less Ni, about 0.7% or less Mo, about 0.1% or less Cu, about 0.1% or less Ti, about 0.1% or less Nb, and about 0.1% or less of the total of W, V, and Zr, by mass.

4. The high carbon hot-rolled steel sheet according to claim 2, further comprising at least one element selected from the group consisting of about 0.005% or less B, about 3.5% or less Cr, about 3.5% or less Ni, about 0.7% or less Mo, about 0.1% or less Cu, about 0.1% or less Ti, about 0.1% or less Nb, and about 0.1% or less of the total of W, V, and Zr, by mass.

5. The high carbon hot-rolled steel sheet according to claim 1, the hot-rolled steel sheet being cooled at cooling rates from 60° C. per second or larger to smaller than 120° C. per second.

* * * * *